United States Patent [19]

Kawanami et al.

[11] Patent Number: 5,061,206

[45] Date of Patent: Oct. 29, 1991

[54] CONNECTOR FOR COAXIAL CABLE

[75] Inventors: Norihide Kawanami; Fumio Kobayashi; Ikujiro Mitani, all of Tokyo, Japan

[73] Assignee: Hirose Electric Co., Ltd., Tokyo, Japan

[21] Appl. No.: 608,463

[22] Filed: Nov. 2, 1990

[30] Foreign Application Priority Data

Nov. 7, 1989 [JP] Japan ..... 1-129365

[51] Int. Cl.[5] ..... H01R 9/05

[52] U.S. Cl. ..... 439/582; 439/585

[58] Field of Search ..... 439/578, 582, 579–581, 439/583–585, 675

[56] References Cited

U.S. PATENT DOCUMENTS

| | | | |
|---|---|---|---|
| 2,754,487 | 7/1956 | Carr et al. | 439/578 |
| 2,952,823 | 9/1960 | Robinson | 439/582 |
| 3,432,798 | 3/1969 | Brishka | 439/582 |
| 3,836,946 | 9/1974 | Geiger | 439/582 |
| 4,799,900 | 1/1989 | Capp et al. | 439/585 |
| 4,881,912 | 11/1989 | Thommen et al. | 439/582 |
| 4,911,660 | 3/1990 | Alf et al. | 439/582 |

FOREIGN PATENT DOCUMENTS

| | | | |
|---|---|---|---|
| 2524582 | 1/1976 | Fed. Rep. of Germany | 439/582 |

*Primary Examiner*—Neil Abrams
*Assistant Examiner*—Ken D. Vu
*Attorney, Agent, or Firm*—Kanesaka & Takeuchi

[57] ABSTRACT

A coaxial cable connector includes a tubular L-shaped outer conductive shell (1) having a trunk portion (5) with a coupling opening (8) and an arm portion (7) extending laterally from said trunk portion and having a connection opening (9); an L-shaped dielectric body (2) placed in the conductive shell and having an L-shaped channel (12) therein; and an L-shaped central terminal (3) placed in the L-shaped channel and having an annular connection portion (3B) with a slit for connection with a central conductor (24) of a coaxial cable (20).

4 Claims, 2 Drawing Sheets

CONNECTOR FOR COAXIAL CABLE

BACKGROUND OF THE INVENTION

1. Field of the Invention

The present invention relates to connectors for coaxial cables.

2 Description of the Prior Art

Coaxial cable connectors having an dielectric body provided within an outer conductive shell to support a central terminal are well known. In order to connect coaxial cables to such connectors at right angles to the central axis of the outer conductive shell, the outer conductive shell has an opening on the side, and the central conductor of a coaxial cable is inserted into the rear groove of a central terminal to perform soldering for connection. In order to support the connected coaxial cable, a tubular holder is provided at the connection opening, and a sleeve is wrapped over the tubular holder and the coaxial cable and then crimped to secure the coaxial cable.

However, in the above coaxial connector, it is necessary to solder the central conductor of a coaxial cable to the rear portion of a central terminal within the small outer conductive shell so that it is very difficult to work, tending to produce poor soldering. In addition, a separate tubular holder must be attached to the outer conductive shell, resulting in the increased number of working steps and manufacturing costs.

SUMMARY OF THE INVENTION

Accordingly, it is an object of the invention to provide a coaxial cable connector which is easy to connect a coaxial cable and inexpensive to make.

According to the invention there is provided a coaxial cable connector which includes a substantially tubular L-shaped outer conductive shell having a trunk portion with a coupling opening and an arm portion extending laterally from said trunk portion and having a connection opening; a substantially L-shaped dielectric body placed in the conductive shell and having an L-shaped channel therein; and a substantially L-shaped central terminal placed in the L-shaped channel and having an annular connection portion with a slit for connection with a central conductor of a coaxial cable.

The central conductor of a coaxial cable is exposed, and a tubular reinforcing terminal is crimped over the central conductor and pushed into the annular connection portion of a central terminal. The slit provided on the annular connection portion permits the connection portion to resiliently expand and hold the reinforced terminal. Then, the coaxial cable and the arm portion of the connector are crimped together with a sleeve. Since the arm portion is concentric with the connection portion, it is only necessary to push the coaxial cable into the arm portion so that the central conductor is pushed into the connection portion.

The above and other objects, features, and advantages of the invention will be more apparent from the following description when taken in conjunction with the accompanying drawings.

DESCRIPTION OF THE PREFERRED EMBODIMENT

Figure 1:
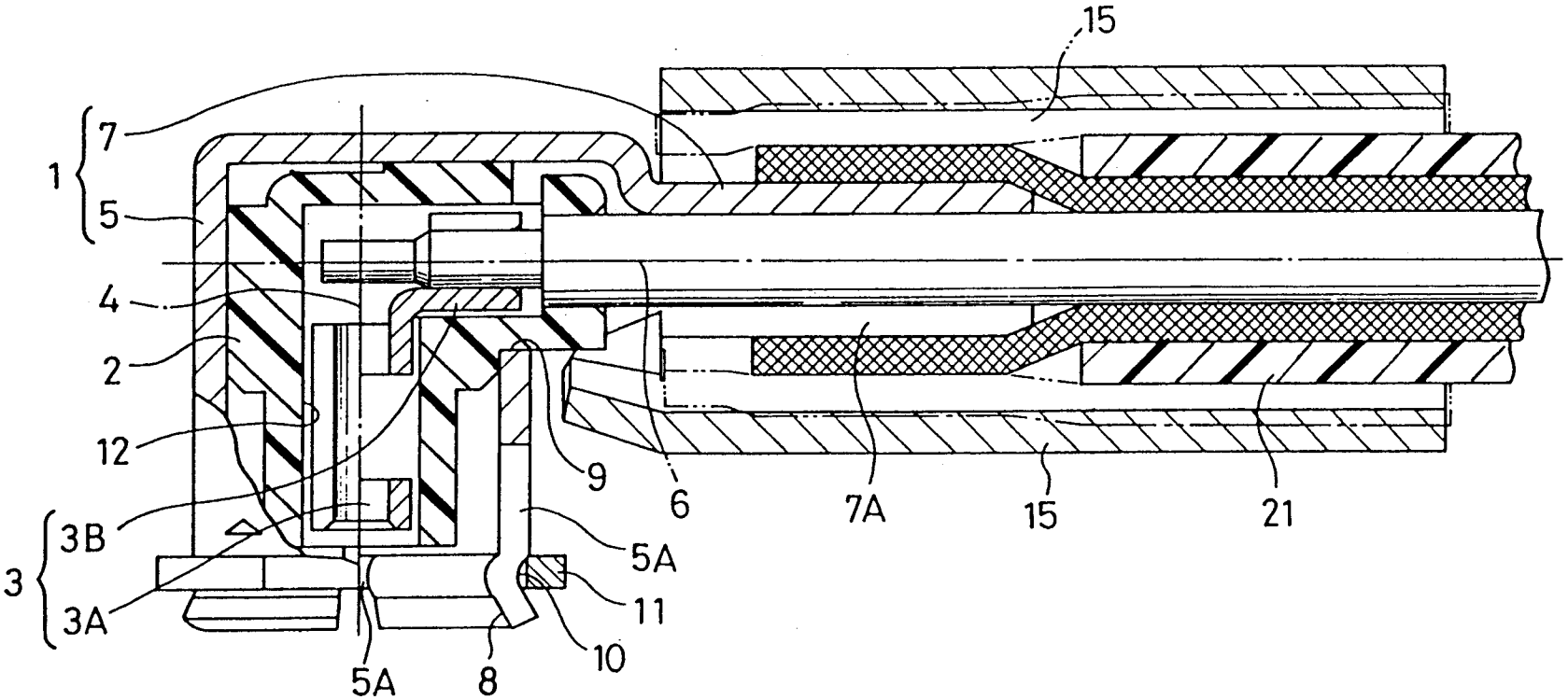
FIG. 1 is a longitudinal section of a coaxial cable connector according to an embodiment of the invention.

FIG. 1 shows a coaxial cable connector to which a coaxial cable is connected. The connector has an L-shaped central terminal 3 within an L-shaped outer conductive shell 1 via an L-shaped dielectric body 2. The outer conductive shell 1 is made by stamping and forming a metal sheet to have a tubular trunk portion 5 about a vertical axis 4 and a tubular arm portion 7 extending laterally about a lateral axis 6 from the trunk portion 5 for holding a coaxial cable.

The trunk portion 5 has a bottom coupling opening 8 for connection with a mating connector and an upper connection opening 9 for connection with a coaxial cable. A number of slits 5A extends upwardly from the lower edge of the trunk portion 5 for facilitating expansion of the coupling opening 8. An annular groove 10 is formed adjacent the lower edge of the trunk portion 5, over which a retention ring 11 is fitted. The retention ring 11 has a polygonal inner surface for contact with the annular groove 10 at a number of points. The arm portion 7 is made integral with the trunk portion 5 to extend along the lateral axis 6 and have a longitudinal slits 7A extending along the lateral axis 6. The outer conductive shell 1 is made by stamping a metal sheet into a shape having a constricted neck portion, bending the shaped sheet to form the tubular trunk portion 5 and the tubular arm portion 7 aligned in a straight line, and then bending the trunk-and-arm unit at right angles at the neck portion, providing a final shape as shown in FIG. 1.

The outer conductive shell 1 has the dielectric body 2 having an L-shaped channel 12. The dielectric body 2 is pushed into the trunk portion 5 until the bent portion of the L-shaped dielectric body 2 abuts on the edge of the connection opening 9 before the outer conductive shell 1 is bent at the neck portion. The channel 12 has the central terminal 3 which is formed in an L-shape along the channel 12 to have an annular contact portion 3A with slits extending along the vertical axis 4 for receiving the contact pin of a mating connector (not shown) and an annular connection portion 3B with a slit extending along the lateral axis 6 for receiving the central conductor (or a reinforcing terminal fitted over the conductor) of a coaxial cable. A crimp sleeve 15 is made of a relatively soft material and has an inner diameter greater than the outer diameter of a coaxial cable.

Figure 2:
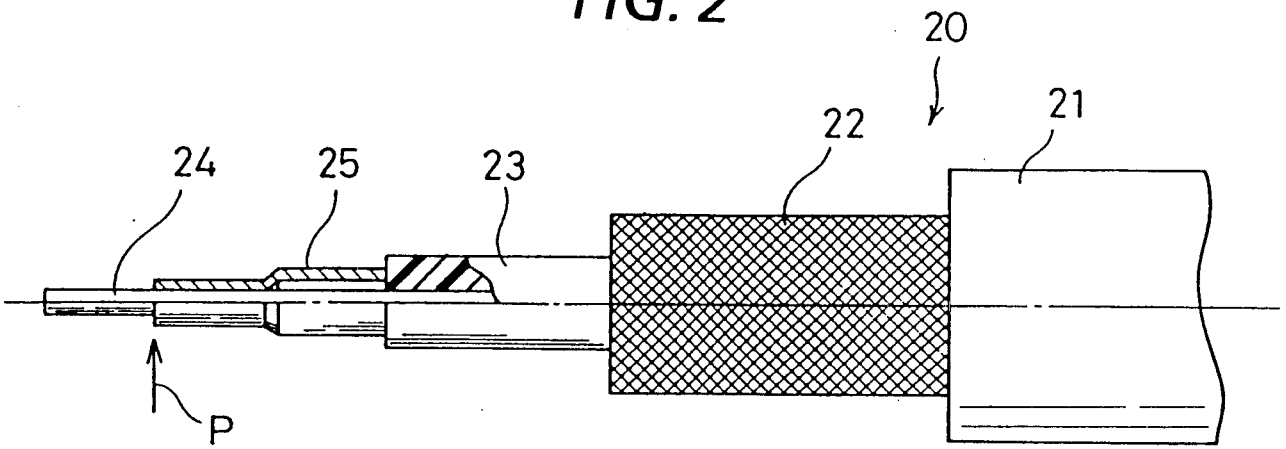
FIG. 2 is a side elevational view, partially in section, of the coaxial cable before connection to the connector of FIG. 1.

The coaxial cable connector is connected to a coaxial cable as follows:

(1) As FIG. 2 shows, a length of the sheath 21 of a coaxial cable 20 is removed to expose the shield wires 22, the inner insulator 23, and the central conductor 24. The reinforcing terminal 25 is fitted over the central conductor 24 and crimped thereto. The central conductor 24 is then cut off at the front end P of the reinforcing terminal 25.

(2) As FIG. 1 shows, a length of the sleeve 15 is fitted over the prepared coaxial cable 20, and the tubular arm portion 7 with the slit 7A is pushed into between the shield wires 22 and the inner insulator 23 so that the reinforcing terminal 25 of the coaxial cable 20 is fitted into the annular connection portion 3B. The annular connection portion 3B is provided with slit so that it resiliently expands and holds the reinforcing terminal 25. Since the tubular arm portion 7 and the annular connection portion 3B are concentric, it is only necessary to push the coaxial cable 20 into the connector so that the tubular portion arm 7 slides into between the inner insulator 23 and the shield wires 22 while the reinforcing terminal 25 is fitted into the annular connection portion 3B.

(3) The sleeve 15 is aligned so as to cover both of the tubular arm portion 7 and part of the sheath 21 and crimped to secure the coaxial cable to the tubular arm portion 7 as shown by two-dot chain lines. Thus, the connection of the coaxial cable to the connector is completed.

According to the invention, it is unnecessary to solder the central conductor of a coaxial cable to the central terminal, resulting in the reliable connection and thus the reliable connector. Since the arm portion is made integral with the outer conductive shell, it is unnecessary to put together these parts.

What is claimed is:

1. A coaxial cable connector comprising:

a substantially tubular L-shaped outer conductive shell having a vertical trunk portion with a coupling opening and a slit extending upwardly from a lower edge thereof for facilitating expansion of said coupling opening, and an arm portion extending laterally from said trunk portion and having a connection opening;

a substantially L-shaped dielectric body placed in said conductive shell and having an L-shaped channel therein; and a substantially L-shaped central terminal placed in said L-shaped channel and having an annular connection portion with a slit for connection with a central conductor of a coaxial cable.

2. The coaxial cable connector of claim 1, wherein said arm portion is concentric with said annular connection portion of said central terminal.

3. The coaxial cable connector of claim 1, wherein said central terminal has an annular contact portion with a lengthwise slit for resiliently gripping a mating contact pin.

4. A coaxial cable connector comprising:

a reinforcing terminal fitted over and crimped to a central conductor of a coaxial cable;

a substantially tubular L-shaped outer conductive shell having a vertical trunk portion with a coupling opening and an arm portion extending laterally from said trunk portion and having a connection opening;

a substantially L-shaped dielectric body placed in said conductive shell and having an L-shaped channel therein; and a substantially L-shaped central terminal placed in said L-shaped channel and having an annular connection portion with a slit for resiliently gripping said reinforcing terminal of said coaxial cable.

* * * * *